US008726591B1

(12) United States Patent
Steffes et al.

(10) Patent No.: US 8,726,591 B1
(45) Date of Patent: May 20, 2014

(54) FIELD TRIMMABLE SIDING CORNER

(75) Inventors: Stephen William Steffes, McPherson, KS (US); Robert David Shaw, Parma, MI (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 11/268,281

(22) Filed: Nov. 3, 2005

(51) Int. Cl.
*E04F 13/073* (2006.01)

(52) U.S. Cl.
USPC ..... 52/287.1; 52/100; 52/535; 52/748.11

(58) Field of Classification Search
USPC ..... 52/288.1, 287.1, 535, 748.1, 748.11, 52/98–100, 748, 11
See application file for complete search history.

(56) References Cited

U.S. PATENT DOCUMENTS 4,015,391 A * 4/1977 Epstein et al. ..... 52/520
4,189,885 A * 2/1980 Fritz ..... 52/287.1
4,279,106 A * 7/1981 Gleason et al. ..... 52/100
5,157,881 A * 10/1992 Tashman et al. ..... 52/98
5,347,784 A * 9/1994 Crick et al. ..... 52/520
6,122,878 A * 9/2000 Pliley ..... 52/528
6,269,591 B1 * 8/2001 Kelly ..... 49/482.1
6,360,500 B1 * 3/2002 Wilcox ..... 52/217
6,635,218 B2 * 10/2003 King ..... 264/536
6,684,587 B2 * 2/2004 Shaw et al. ..... 52/288.1
6,907,702 B2 6/2005 Gilbert et al.
6,939,036 B2 9/2005 Beck et al.
7,204,059 B2 * 4/2007 Schiffmann et al. ..... 52/211
7,228,665 B2 * 6/2007 Perry ..... 52/287.1
2002/0121057 A1 * 9/2002 Steffes et al. ..... 52/287.1

* cited by examiner

*Primary Examiner* — Adriana Figueroa
(74) *Attorney, Agent, or Firm* — Alexander H. Plache; Abel Law Group, LLP

(57) ABSTRACT

A corner piece for covering or capping a structure corner adjacent shake shingle siding characterized by a lineally variable contour includes a field modifiable trim strip for reflecting and accommodating the contour of the siding adjacent the structure corner. A method of siding a structure with the new corner piece and a siding system including the new corner piece and lineally variable contour siding panels are also disclosed.

20 Claims, 5 Drawing Sheets

FIELD TRIMMABLE SIDING CORNER

BACKGROUND OF INVENTION

This invention relates to siding products generally, and more particularly relates to synthetic siding corners for use with synthetic siding products having a random length or random appearance wood shake or slate impressions formed thereon.

Wooden shingles and shakes represent a dominant part of a century old architectural style. The style is still considered very attractive and maintains substantial popularity. It is not surprising wooden shakes and shingles siding products are still used in the construction of homes, businesses and other structures. Unfortunately, these wooden products require significant maintenance. The rising cost of maintenance is detrimental to retaining buildings constructed in such a style. Moreover, the cost of wood siding is also rising and has become relatively expensive, as well as quite labor intensive to install. Further, the durability of wooden products, such as those constructed from cedar, lags far behind that of products made of synthetic materials. Therefore, a considerable number of synthetic siding products have been created for the building industry. These products seek to simulate the wooden appearance of, for example, cedar shingles or cedar shake shingles. These simulated wood siding products are typically formed from materials such as polyvinyl chloride or polypropylene.

Once synthetic siding panels are installed onto the exterior sheathing of a structure, it often becomes necessary to place a corner cap over the exposed ends of the siding panels. In the case of synthetic siding simulating horizontal boards, the corner cap is typically a long, vertically extending corner piece with a vertically extending slot or pocket for receiving the exposed ends of the simulated horizontal boards of the synthetic siding. A solution of a tall corner providing a pair of continuous vertically extending slots is aesthetically less desirable for synthetic siding simulating wood shakes, cedar shingles or slates because an impression of mixed architectural styles or, worse, reduced craftsmanship or, still worse yet, artificiality may be undesirably conveyed. Thus, efforts have been made to match the ornamental appearance of the siding panel with the corner cap appearance, so as to avoid an unaesthetic or artificial looking final structure. One example is the simulated shake siding corner described in U.S. Pat. No. 4,015,391 to Epstein, et al. entitled "Simulated Cedar Shake Construction," the entirety of which is hereby incorporated by reference herein. As previously extensively reviewed in U.S. Pat. No. 6,684,587 of the present inventors, incorporated by reference herein in its entirety, Epstein describes simulated cedar shake siding panels that are attached to the outside walls of a structure and a corner piece that may be used in conjunction with the described siding panels. The shortcomings of the Epstein corner have been previously discussed.

A recurrent and still remaining theme in the synthetic simulated siding field is how to effectively and efficiently simulate a random selection of shake shingles in each course. One significant advance in this effort is represented by U.S. Pat. No. 6,907,702 entitled "Staggered Look Shake Siding" also incorporated herein in its entirety by reference. However, due to the absence of lineal contour uniformity responsible for the improved appearance and impression of such siding, new challenges for corner capping are encountered. One less than desirable solution is to ignore a gap frequently encountered between siding with lineal varying contour and corner cap.

Therefore, there remains a need for a better corner piece that provides the appearance of natural corners on the courses of a siding facade employing simulated cedar impression siding panels and for a corner piece that more effectively integrates a corner piece into a simulated cedar shake shingle facade to eliminate a gap that allows dirt and insects access through the siding system. The present invention represents an effective and efficient solution to the undesirable yet frequently observed significant gap between siding and corner cap.

SUMMARY OF THE INVENTION

The present invention, in a preferred embodiment, is a corner piece for covering a structure corner defined by two mating walls. The two mating walls are generally covered with siding panels fastened to the mating walls adjacent the structure corner. The siding panels each contain at least one multiple shake shingle impression course. Each multiple shake shingle impression course may be understood as defined by a first shake shingle impression adjacent the structure corner along with a plurality of subsequent shake shingle impressions. The first shake shingle impression and the subsequent shake shingle impressions of each multiple shake shingle impression course each have impressions with a bottom edge displaced outwardly from the mating wall and each bottom edge is characterized by a bottom height or extent selected from a plurality of bottom heights or extents with the plurality of bottom heights or extents arrayed along each shake shingle impression course. Alternatively, the impression of a plurality of bottom heights may be conveyed by bevel at the bottom edges of the shake shingle impression where the bevel angles are varied. Together, the appearance is conveyed of a course of randomly selected and individually attached random length shake shingles. The new corner piece includes a first vertically oriented shake shingle impression and a second vertically oriented shake shingle impression. Each of these shingle impressions has an exterior face and an interior face and a first lateral edge and a second lateral edge opposite said first lateral edge. The first vertically oriented shake shingle impression and said second shake shingle impression meet at a common corner, which is defined by the first lateral edges. Further, in this new corner piece, at least one of the second lateral edges has a field modifiable fill strip associated with the vertically oriented shake shingle impression. The field modifiable fill strip may be altered to remove any interfering portion of the field modifiable fill strip, thereby coordinating, matching and receiving the bottom edge of the first shake shingle impression of an adjoining multiple shake shingle impression course of an adjoining siding panel of the adjoining mating wall by partially covering the first shake shingle impression with the vertically oriented shake shingle impression of the corner piece and the at least one second lateral edge of the corner piece. Significantly, by use of such a field modifiable fill strip, a significant gap is avoided between the at least one of the second lateral edge of the corner piece and the bottom edge of the first shake shingle impression. The corner piece can also be understood as having the second lateral edge with the field modifiable trim strip originally manufactured to accommodate and reflect one possible observed contour of the last decorative impression of the siding panel adjacent the corner. Because the last decorative impression of the siding panel adjacent the corner may be one of a plurality of a fixed number of possible decorative impressions, due to the need to coordinate with the predetermined horizontal extent of the wall by cutting or terminating the siding panel at some lineal position, the field modifiable trim strip may be utilized to modify the accommodated and reflected contour at the lateral edge of the corner piece so as to avoid a significant gap between the observed contour of the terminated siding panel and the lateral edge of corner piece. Thus, the present invention might alternatively be understood as a corner piece with a lateral edge reflecting and accommodating the smallest available decorative impression of a siding panel and thereby avoiding a significant gap, which corner piece includes a field modifiable fill strip which can be progressively removed to accommodate and reflect larger observed contours from a siding panel with a lineally variable contour. These larger observed contours may be encountered when such a siding panel is cut or terminated due the predetermined horizontal extent of a wall mating at a corner.

By "significant gap" herein is meant a gap or unfilled space between the bottom edge of an impression of a siding panel and a lateral edge on a corner piece on the order of about ⅛ inch.

In a preferred application of this embodiment, the corner piece might be used with a lineally variable contour siding product such as CertainTeed® D9RS™ simulated cedar rough split shake panels, which panels have an array of shake shingle impressions in courses where the apparent shake shingle lengths or bottom edges vary by one of four ⅛ inch increments. In such an application, the field modifiable fill strip preferably includes three guide marks or indicia at about ⅛ inch increments. The guide marks, in this situation, correspond with the possible bottom heights of the shake single impressions of the D9RS™ siding panel which might be encountered as a result of terminating the panel adjacent the structure corner, as appropriate, based on starting the panel from another corner. This allows the corner piece to partially overlap the last shake shingle impression of the shake shingle impression course and avoid a significant gap.

It is noteworthy in such an installation, that a field modifiable trim strip is only needed on one side of the corner piece, most preferably, the right side (rightward second lateral edge) of the corner piece, since the horizontally installed panels are started on the right side of each wall (when viewed looking at a full wall) which also corresponds to the left side of a corner piece (when viewed properly oriented for installation on a corner and facing the corner.) Alternatively, this situation might be reversed for installations in which the synthetic siding is intended to start from the left side of the wall. In yet another embodiment, the corner piece could include field modifiable trim strips on each side of the corner piece, so as to allow independently, accommodation of variable shake lengths of horizontally installed siding panels on one or both sides of the corner of the wall. The field modifiable trim strip in a corner piece can be for an outside corner or for an inside corner. Moreover, the field modifiable trim strip in a corner piece may alternatively be used in corner pieces intended for obtuse or acute angles as well. Such obtuse and/or acute corners may be used in siding for architecturally detailed situations where such obtuse or acute corner angles are encountered, for example about a bay window.

In a preferred embodiment, the corner piece has a nailing flange at an upper extent of the corner piece. The preferred nailing flange overlies each of the mating walls and includes a nailing aperture for each of the mating walls. Most preferably, the corner piece also includes a first hook directed downwardly along one mating wall; a second hook, directed downwardly along the second mating wall, and a combined hook receiver on the interior face adjacent the lower edge of the corner piece. The hook receiver extends about the common corner and serves to lock the bottom of the corner piece to the corner. Noting that the preferred D9RS™ siding panels have two courses of multiple shake shingle impressions, the preferred corner piece also has two courses, each with a field modifiable trim strip. In another alternative embodiment, the siding panel and associated corner piece can have three or more courses of shake shingle impressions. Such an alternative embodiment would be beneficially employed in combination with siding panels having three or more courses of impressions. CertainTeed® Random Hand-Split Shakes siding panel product, a synthetic paneling with a course of vacuum formed impressions having differently beveled lower edges on the shingle impressions that convey a look of random shake lengths might also be used with the present invention in an embodiment in which various bevel angles are accommodated by the modified trim strip.

In another embodiment, the preset invention is a method of siding a structure at a structure corner, the structure corner being defined by two mating walls. The new method includes the steps of (1) providing two siding panels. Preferably, these are panels of CertainTeed® D9RS™ siding, but could be other panels of lineally variable contour including scalloping; (2) fastening the two siding panels in a horizontally aligned orientation to the mating walls adjacent the structure corner. This attachment to the wall defines an end portion on each of the siding panels. One of the siding panels is typically cut or otherwise terminated adjacent the structure corner, due to starting from another corner and working toward the corner under discussion; (3) providing a corner piece, per the present invention, having a first and second decorative impression panels meeting at a common corner and having a field modifiable filler strip on at least one of the decorative impression sides opposite the common corner of the corner piece; (4) observing the contour of the impression of the terminated siding panel adjacent the corner and then, if needed due to an inability to fit, field modifying the field modifiable filler strip of the provided corner piece to accommodate and reflect the contour of the terminated siding panel; and, (5) attaching the corner piece over the end portion of each of the siding panels with the common corner of the corner piece aligned with the structure corner, such that the modified field modifiable filler strip accommodates and reflects the contour of the terminated siding panel, and such that a significant gap is avoided between the provided corner piece, including any needed modification of the field modifiable filler strip and the terminated siding panel. The method thereby, in a preferred embodiment, results in the installed corner piece conveying an impression of mitered shake shingles capping horizontal courses of randomly selected and casually attached cedar shake shingles. Overall, an impression of casually elegant cedar shake shingles is strongly presented and conveyed.

Within the most preferred embodiment, the step of attaching the corner piece includes fastening the nailing flange to the structure corner. In subsequent higher courses on the corner, the installation method also includes the step of sliding the corner piece upwardly, thereby capturing the downwardly directed hooks of a previous corner piece in the current corner piece's hook receiver to anchor both the top and bottom of the corner piece to the structure corner while covering the ends of the siding's impression courses.

In still another embodiment, the present invention is a system for siding a structure characterized by a plurality of walls, with two of the walls mating at a structure corner. The new system includes a plurality of siding panels for application onto the walls, with the panels characterized by a lineally variable contour. The siding panels may be cut or terminated to coordinate with the predetermined horizontal extent of a wall leading to the corner. (Typically, application of siding panels begins at one corner and leads toward the corner under consideration, and therefore, troublesome cuts or terminations are then encountered.) Along with the panels, the new system also includes a plurality of corner pieces for subsequent application to the structure corner after application of the siding panels, with the corner pieces characterized by first and second corner panels meeting at a common corner and a field modifiable trim strip on an edge of one of at least one of the corner panels opposite the common corner. Modification of the field modifiable trim strip facilitates accommodation and reflection of the observed contour of the lineally variable contour adjacent a termination of a siding panel. In this new system, a significant gap may be avoided between the corner piece and the terminated siding panel. This is because the field modifiable trim strip allows the troublesome observed contour to be accommodated and reflected.

Preferably, the siding panels of the system include temperature related accommodating expansion fastening apertures, such as available on CertainTeed® D9RS™. The system also preferably includes a temperature indication system for guiding spacing of adjacent panels and application of fasteners to the temperature related accommodation fastening apertures. Details of the temperature indicator system are available in U.S. Pat. No. 6,939,036 also incorporated herein by reference in its entirety. Additionally, instructions for installation so as to avoid a significant gap between the corner piece and a terminated siding panel may be included in the system. Such instructions could particularly detail the steps of observing the contour to be accommodated and reflected and then, if needed, removing the interfering portion of the field modifiable trim strip.

Preferably, the field modifiable trim strip has a thickness not more than about half of the thickness of the remainder of the corner piece. Preferably, the corner piece is molded. However, the corner piece may be provided by a method including a process of injection molding, compression molding, vacuum forming, extrusion, and/or co-extrusion. Preferably, the corner piece includes materials of PVC or polypropylene. The corner piece may also include an exterior face layer, which is a capstock and/or a coating. Preferably, the field modifiable trim strip has guide marks to facilitate trimming for an observed contour. Preferably, the shake shingle impression courses have shake shingles impressions selected from four ⅛ inch increments of apparent length and the field modifiable trim strip has three guide marks to facilitate trimming for an observed contour corresponding to each of the three longer ⅛ inch increments which might be encountered with a cut siding panel. The smaller impression contour of the four impressions is accommodated and reflected without trimming so that a significant gap is avoided. Alternatively, the field modifiable trim strip might be modified or cut on an angle other than horizontal and perpendicular to the wall so as to accommodate a beveled bottom edge on impressions of the siding panels. Preferably, the polymeric materials are selected for like coloring material or contrasting coloring material.

The above and other features of the present invention will be better understood from the following detailed description of the preferred embodiments of the invention that is provided in connection with the accompanying drawings.

BRIEF DESCRIPTION OF DRAWINGS

The accompanying drawings illustrate preferred embodiments of the invention as well as other information pertinent to the disclosure, in which.

DETAILED DESCRIPTION OF THE INVENTION

By "outside" corner piece, it is meant that the corner piece is shaped to cover an outwardly protruding or "outside" corner of a structure as opposed to an inwardly formed or "inside" corner of a structure. In the case of an outside corner, the decorative exterior faces of the corner meet at an angle greater than 180 degrees and preferably about 270 degrees. In the case of an inside corner, the decorative exterior faces of the corner meet at an angle less than 180 degrees preferably about 90 degrees. In each case, for an outside or inside corner other angles are possible to accommodate other architectural details, such as for example bay windows. By "lineally variable contour" and "lineal variability in contour" and similar language herein is meant that the contour along the exterior lineal extent of a panel or course of impressions on a panel changes, for example, the bottom edge or bevel of an impression changes from one impression to the next or alternatively each of the impressions may have variation across the impression or both effects may be present. Examples of products characterized by "lineal variability in contour" include, but are not limited to: CertainTeed® D9RS™ simulated cedar rough shake panels, which panels have an array of shake shingle impressions in courses where the apparent shake shingle lengths or bottom edges vary by one of four ⅛ inch increments; CertainTeed® Random Hand-Split Shake siding panel product, a synthetic paneling with a course of vacuum formed impressions with different beveled lower edges on the shingle impressions, the different bevel angles conveying the appearance of different lengths of shakes; and panels with courses of scalloped or half-round shingle impressions.

Figure 1:
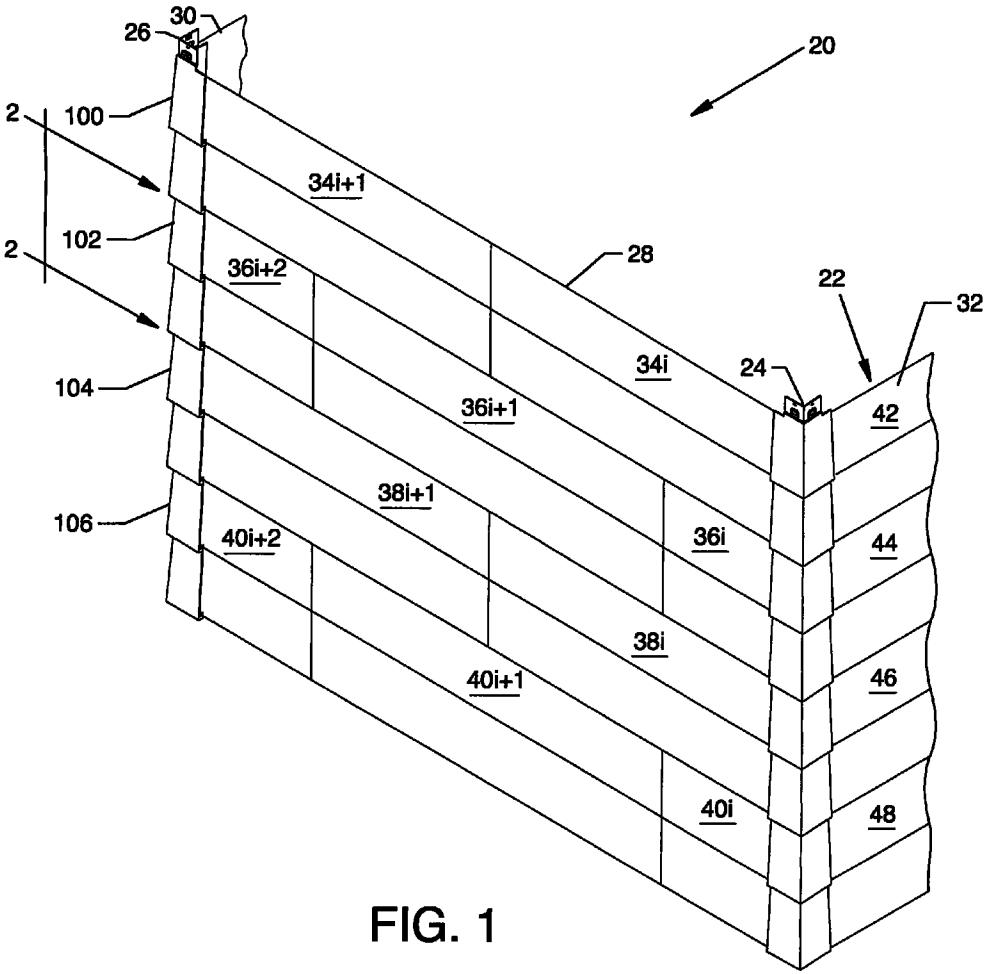
FIG. 1 shows a front perspective view of a system of the present invention installed on a structure wall.

As shown in FIG. 1, the present invention in one embodiment, is a system 20 for siding a building or structure 22 including presently depicted portions such as outside corners 24 and 26. Connecting the corners 24 and 26 is a wall 28 that meets adjoining walls 30 and 32 at corners 26 and 24, respectively, and thereby serves to define the corners 26 and 24. The system 20 includes a plurality of siding panels 34*i*, 34*i*+1, 36*i*, 36*i*+1, 36*i*+2, 38*i*, 38*i*+1, and 40*i*, 40*i*+1, 40*i*+2, 42, 44, 46, 48, etc. These siding panels 34*i*, 34*i*+1, 36*i*, 36*i*+1, 36*i*+2, 38*i*, 38*i*+1, and 40*i*, 40*i*+1, 40*i*+2, 42, 44, 46, 48, etc. are a first component of the present system 20 and are explained in some extended detail at this time so that other components, to be explained later, will be more easily comprehended. The siding panels 34*i*, 34*i*+1, 36*i*, 36*i*+1, 36*i*+2, 38*i*, 38*i*+1, and 40*i*, 40*i*+1, 40*i*+2, etc. are horizontally attached, oriented and stacked upon wall 28. Similarly, siding panels 42, 44, 46, and 48 are attached on wall 32. Notably, panels 42 and 34*i*, 34*i*+1, are substantially aligned with each other; panels 36*i*, 36*i*+1, 36*i*+2 and 44 are substantially aligned with each other; panels 38*i*, 38*i*+1 and 46 are substantially aligned with each other;

and panels 40*i*, 40*i*+1, 40*i*+2, and 48 are substantially aligned with each other. Siding panels are guided into substantial alignment and horizontal orientation. Typically, this is facilitated by the initial use of a level line used to install a lower starter set of substantially aligned siding panels and upper substantially aligned sets of siding panels overlap the lower sets to allow water to be shed outwardly and away from the structure 22.

Figure 2:
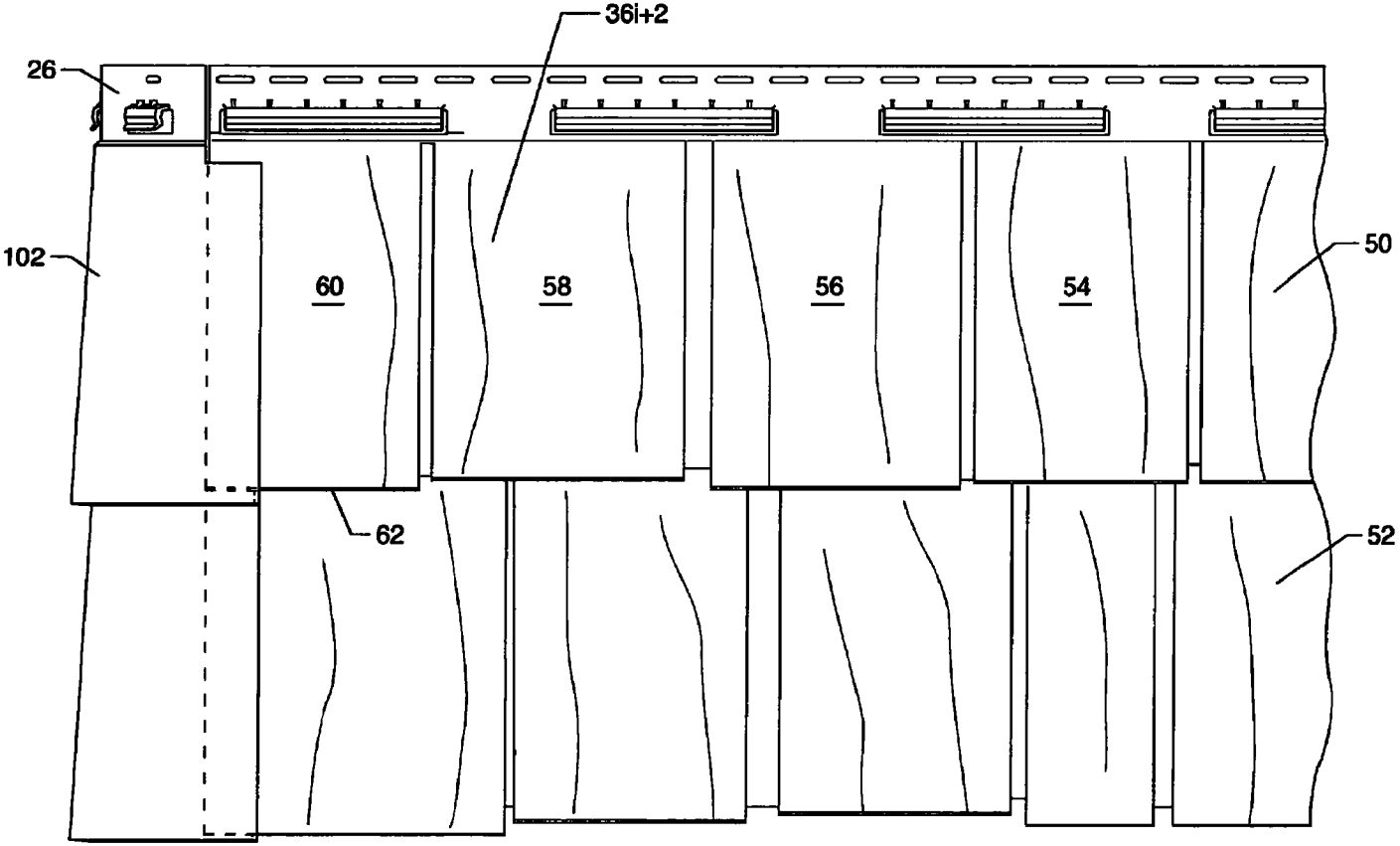
FIG. 2 is a portion of the front perspective view of FIG. 1 showing increased detail from an outside corner at 2-2 of FIG. 1 and a siding panel termination, shown in dotted outline, beneath a corner piece.

In a most preferred embodiment, CertainTeed® D9RS cedar rough split siding panels may be used as the siding panels and are generally exemplary of features characteristic of the siding panels 34*i*, 34*i*+1, 36*i*, 36*i*+1, 36*i*+2, 38*i*, 38*i*+1, 40*i*, 40*i*+1 and 40*i*+2 of the system 20. In particular, each siding panel, for example siding panel 36*i*+2, has two apparent courses 50 and 52 of shake shingle impressions as indicated in FIG. 2. Each course 50 and 52 has a plurality of shake shingle impressions schematically depicted for part of course 50 as 54, 56, 58, and 60. The shake shingle impressions 54, 56, 58, and 60 are selected from a plurality of apparent shingle lengths, which for D9RS™ are in ⅛ inch increments and the various lengths are distributed through the course in a random or apparently random fashion. More specifically, the bottom edge 62 of shingle shake impression 60 of course 50 of siding panel 36*i*+2 could be any one of a plurality of lengths. Preferably at least three, or more preferably, at least four different apparent lengths are available choices. The significance of this random or apparent random length for each shake shingle impression is a lineally variable contour for the course 50 and similarly also for the course 52. Thus, the siding panel 36*i*+2 has a lineally variable contour, as well as its courses 50 and 52. (It should be noted that other usable siding panels employ a number of differing bevels or bevel angles to achieve a similar random appearance and are also considered linearly variable in contour and form a separate embodiment of the present invention.) Moreover, application of siding panels for a wall (for example consider wall 28) preferably begins from the right corner (for wall 28, the right corner is corner 24) and proceeds toward left corner (for wall 28 the left corner is corner 26.) Of course, the opposite handed system might be used, starting at left corners and working toward right corners. Multiple siding panels may be required to extend the width of wall 28, but a termination or cut of the siding panel will frequently occur near left hand corner 26. In this embodiment, the right most shake shingle impressions of a siding panel always have the same starting contour. To further enhance a casual and random appearance, the starting contour occurs once again at a set distance from the right end, most particularly at about 29 inches from the right end of the siding panel. Thus, the contour adjacent the right edge of a siding panel is constant in all panels. At nearly any other distance, other than about 29 inches, from the right end, the contour will be some nearly random selection from the four ⅛ inch increments. In an alternative embodiment, the siding panel may include 1, 2, 3 or more courses of impressions on a siding panel.

Figure 3:
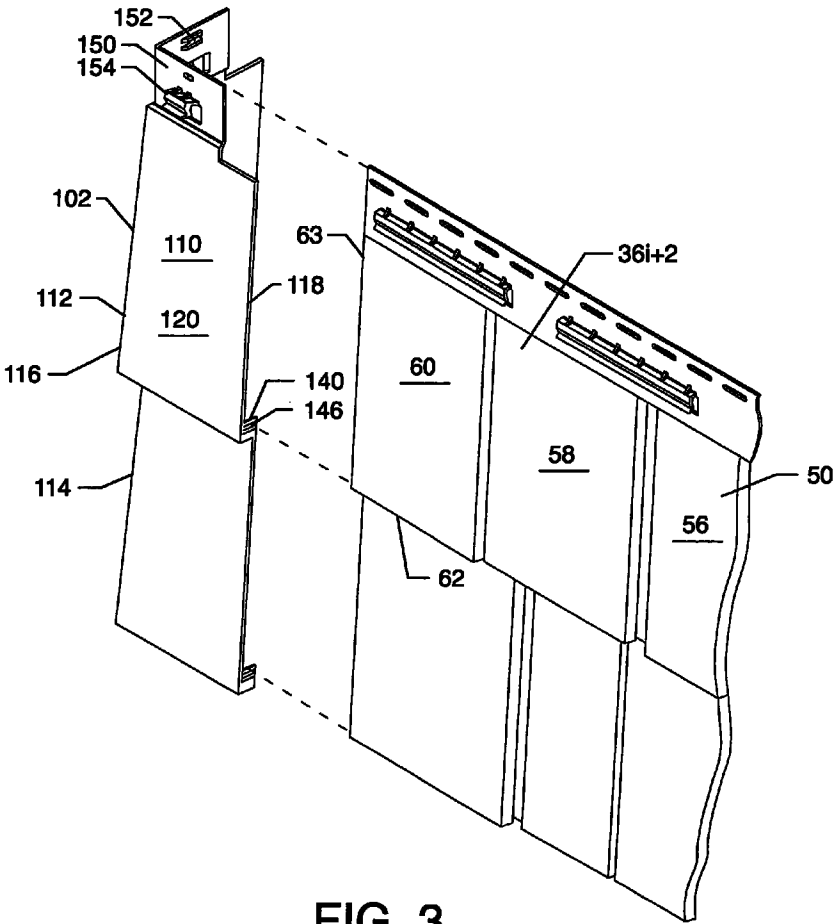
FIG. 3 is a portion of the front perspective view of FIG. 1 showing increased detail from FIG. 2, as in FIG. 2, but with the corner piece separated from the siding panel.

Referring now to FIG. 3, an installer of the siding panel 36*i*+2 with distance positioned termination 63, adjacent corner 26 is presented with a challenging contour resulting from the random impression conveyed by the siding panel 36*i*+2. In particular, bottom edge 62 of shake shingle impression 60 has a length longer, and therefore a larger contour, than the smallest of the shake shingle impressions of course 50, for purposes of discussion only the smallest contour might be represented by shake shingle impression 58.

The system 20 also includes a second component type, a plurality of corner pieces 100, 102, 104, and 106 of FIG. 1. Explanation is focused herein on representative corner piece 102 as perhaps best viewed in FIG. 3. Corner piece 102 provides a means to accommodate the larger contour encountered at panel cut or termination 63. Such a termination 63 places shake shingle impression 60, or a portion thereof, adjacent corner 26 and the larger contour observed for shake shingle impression 60 adjacent corner 26 is, in this embodiment, because the bottom edge 62 is at a lower height or associated with a longer apparent shingle impression. Additionally, it is important to avoiding leaving a significant gap between corner piece 102 and the contour of shake shingle impression 60 of siding panel 36*i*+1. More specifically, corner piece 102 has a right panel 110, with an upper single shake shingle impression 112 course and a lower single shake shingle impression 114 course. Panel 110 has a lateral edge meeting a similar lateral edge of a left panel at common corner 116 and another outer lateral edge 118 opposite the common corner 116. The right panel 110 has an interior face (not shown) and an exterior face 120. Situated at the bottom of the outer lateral edge 118 is a field modifiable trim strip 140.

The field modifiable trim strip 140 is situated at a location suited to facilitating accommodation and reflection of the various possible contours of the shake shingle impression 60, and in particular the bottom edge 62, of the siding panel 36*i*+2 at termination 63. That is, for the shortest shake shingle impression, no field modification is required and the bottom edge of the siding panel course is accommodated within the upper portion of the lateral edge 118 and the shortest shake shingle impression will abut the unmodified field modifiable trim strip 140 and a significant gap will be avoided.

Figure 4:
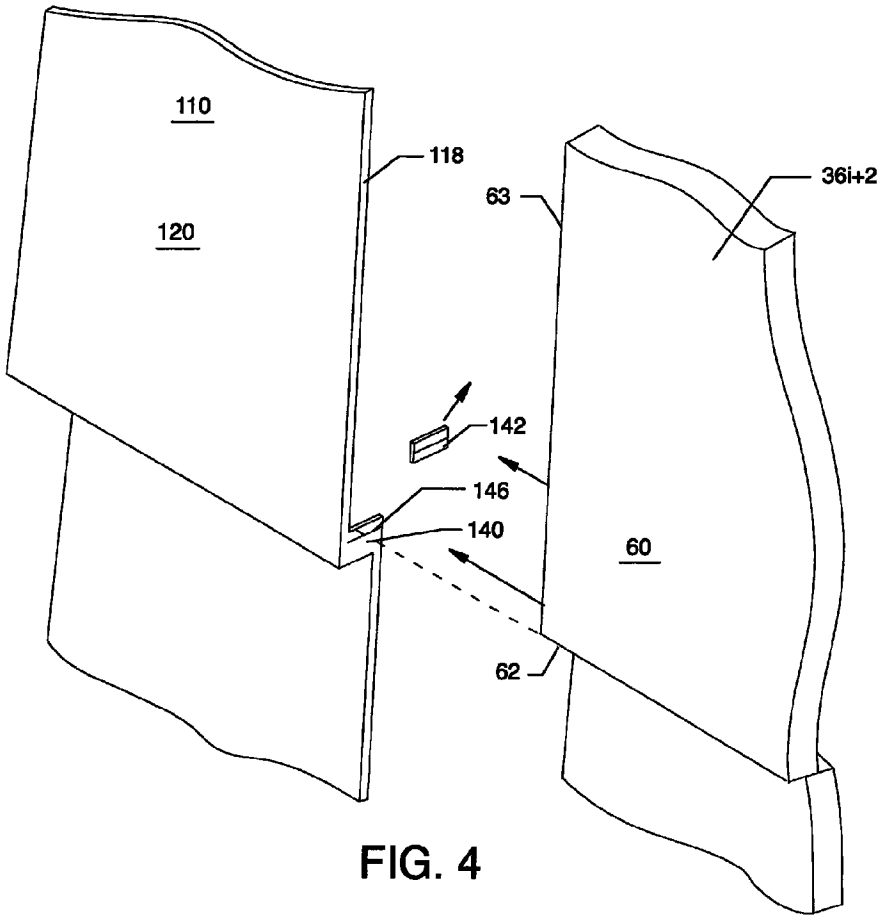
FIG. 4 is an enlarged fragmentary view of FIG. 3 showing two increments of the field modifiable trim strip being removed; and, FIG. 5 is an enlarged fragmentary view of FIG. 3, showing an alternative fragmentation with three increments of the field modifiable trim strip being removed.
Figure 5:
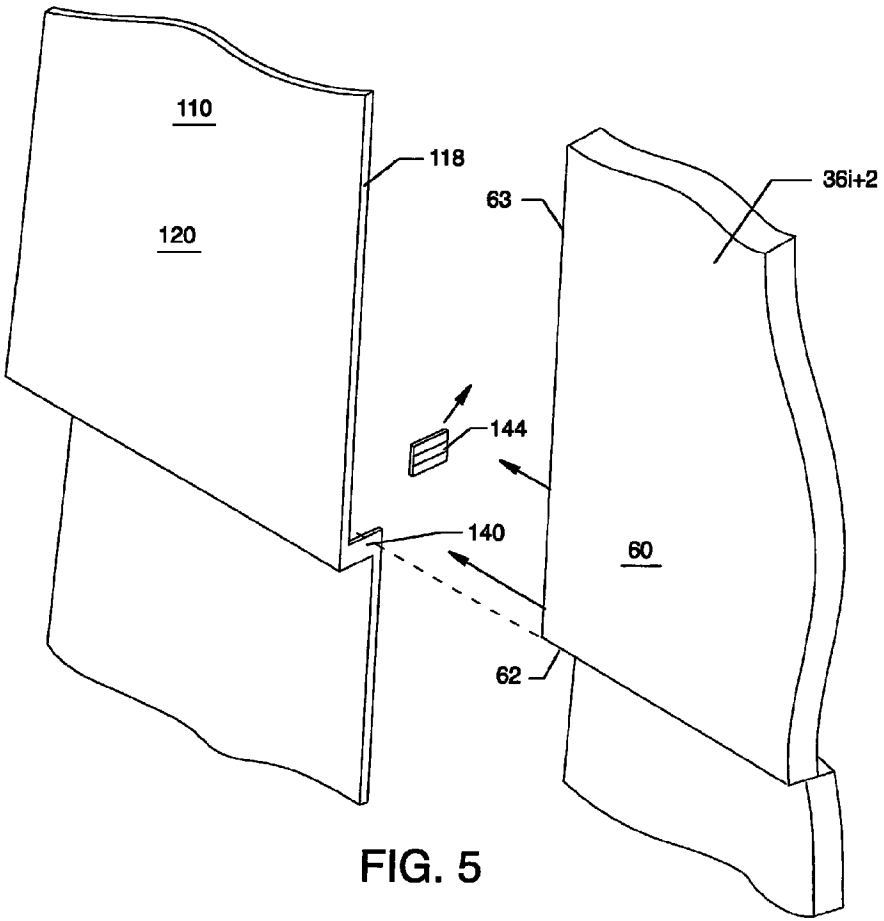

If, however, the contour of a two-increment longer shake shingle impression is encountered at termination 63, a corresponding extent or interfering portion 142 of the field modifiable trim strip 140 is necessarily removed as depicted in FIG. 4. Similarly, as depicted in FIG. 5, if a three-increment longer shake shingle impression 60 is encountered, the corresponding extent or interfering portion 144 of the field modifiable trim strip 140 is necessarily removed as depicted in FIG. 5. In both cases, the remaining portion of the newly modified field modifiable trim strip 140 will appropriately abut the correspondingly longer shake shingle impressions 60 at bottom edge 62 and a significant gap will be avoided.

Preferably, the field modifiable trim strip 140 has indicia 146, in the form of guides or marks visibly present thereon to facilitate removal of any excess material by serving a guide. Most preferably, the indicia 146, in the form of guides or marks or indents, correspond to increments occurring in the lineally variable contours to be encountered. Most preferably, the field modifiable trim strip 140, serving only to abut the shake shingle impression 60 at the bottom edge 62 adjacent the termination 63, is formed of thinner material than the bulk panels 120 of the corner piece 110. It is especially preferred that the field modifiable trim strip 140 be about one-half the thickness of the bulk panel thickness. While the field modifiable trim strip 140 may be cut in any manner, the use of a utility knife is particularly compatible, most particularly when the thickness is about one-half of the bulk panel thickness. Most preferably, the indicia 146 may be in the form of indentations extending substantially along the location of a potential desired cut. Such most preferred indented indicia 146 further reduce the thickness of polymeric material to be severed, thereby further reducing the effort required and the accuracy of the material removal.

The corner piece 102 also includes an upper nailing flange 150 with nail apertures 152, a pair of downwardly directed hooks 154 on the exterior face of the upper nailing flange 150 and a hook receiver system (not shown) at the lower extent of the corner piece 102 on the interior face. Preferably, the siding panels 34*i*+1, 36*i*+2, 38*i*+1, 40*i*+2 are spaced about 3 inches from the structure corner 26 so as to leave attachment space for the nailing flange 150 between the structure corner 26 and the cut or termination, for example 63 of siding panel 36*i*+2. Such spacing is sufficient and adequate for covering the end portions of the siding panels, such as 36*i*+2 since the right panel 110 and left panel (not shown) of the corner piece 102 are each about 4.5 inches in width.

In another embodiment, the present invention is a method of siding a structure at a structure corner 26 as shown in FIG. 1, the structure corner 26 being defined by two mating walls 28 and 30. The inventive method includes the steps of (1) providing two siding panels, for example panel 36*i*+2 and a horizontally aligned panel on wall 30. Preferably these siding panels are panels of D9RS™ siding. Alternatively, the provided siding panels are characterized by preferably having two or more courses of decorative impressions, each courses covering about 4 or more inches of vertical dimension on average and further characterized as having lineal variation in the apparent length or apparent bottom edges, or bevels, of the impressions within each course; (2) fastening the two siding panels in a horizontally substantially aligned orientation to the mating walls adjacent the structure corner. This attachment to the wall defines an end portion on each of the siding panels. One of the siding panels, for example 36*i*+2, is typically terminated adjacent the structure corner 26, due to starting from another corner, for example corner 24, and working toward the corner under discussion, for example corner 26; (3) providing a corner piece 102, per the present invention, having a first 110 and second (not shown) decorative impression panels meeting at a common corner 116 and having a field modifiable filler strip 140 on one lateral edge of the decorative impression sides opposite the common corner 116 of the corner piece 102; (4) observing the contour impression of the terminated siding panel 36*i*+2 adjacent the corner 26 and then, if needed due to an inability to fit, field modifying the field modifiable filler strip 140 of the provided corner piece 102 to accommodate the contour of the terminated siding panel 36*i*+2. This observation step may involve identification of the contour, actual quantitative measurement, or may employ visual estimation or other like methods to determine the necessity of and appropriate extent of field modification. (5) Attaching the corner piece 102 over the end portion of each of the siding panels with the common corner 116 of the corner piece 102 aligned with the structure corner 26, such that the field modifiable filler strip 140 accommodates the contour of the terminated siding panel 36*i*+2, and such that a significant gap is avoided between the provided corner piece 102, including any needed modification of the field modifiable filler strip 140 and the terminated siding panel 36*i*+2. The method thereby, in a preferred embodiment, results in the installed corner piece 102 conveying an impression of mitered shake shingles capping horizontal courses 50 and 52 of randomly selected and casually attached cedar shake shingles. Overall, an impression of casually elegant cedar shake shingles is strongly presented and conveyed. The observation step is not limited to a specific observation scheme but may, by way of example, be accomplished by test fitting the corner piece or by employing a series of templates or by measuring with a tape measure or identification mechanism such as a coded indicia on or near the decorative impression to be reflected and accommodated.

Finally, it should be pointed out that the new corner piece 102 is an embodiment of the present invention. It would be well within the ken of those familiar with this art to modify the field modifiable fill strip 140 of this corner piece 102 to accommodate and reflect the contour of other lineally variable siding panels, whether or not characterized by incremental changes in contour. For example, a fill strip modifiable under field conditions might be used with a scalloped pattern siding panel having a termination near a corner. Additionally, though less preferred and less elegantly devised, a separate fill strip might be provided and used to subsequently fill and thereby avoid a significant gap after initial installation of siding panels and corner pieces lacking a fill strip.

Although various embodiments have been illustrated, this is for the purpose of describing, and not limiting the invention. Various modifications will become apparent to one skilled in the art and are within the scope of this invention described in the attached claims.

We claim:

1. A corner piece for covering a structure corner adjacent shake shingle impression siding, the corner piece comprising:

an upper vertically oriented shake shingle impression, comprising an upper exterior face, an upper interior face, a first top edge, a first bottom edge opposite the first top edge, a first upper side edge, and a second upper side edge; and a lower vertically oriented shake shingle impression, comprising a lower exterior face, a lower interior face, a second top edge, a second bottom edge opposite the second top edge, a first lower side edge, and a second lower side edge, wherein the upper vertically oriented shake shingle impression and the lower vertically oriented shake shingle impression are adapted to each accommodate a termination of a shake shingle impression siding, wherein at least one of said first upper side edge and second upper side edge having a first field modifiable fill strip situated at a bottom of said at least one of said first upper side edge and second upper side edge, and wherein at least one of said first lower side edge and second lower side edge having a second field modifiable fill strip situated at a bottom of said at least one of said first lower side edge and second lower side edge, said first and second field modifiable fill strip having an upwardly directed abutment edge and a vertically oriented face depending therefrom, said vertically oriented face of said first and second field modifiable fill strip further oriented generally perpendicular to the interior face of the upper vertically oriented shake shingle impression, wherein the first field modifiable fill strip and the second field modifiable fill strip include increments in the form of indents.

2. The corner piece of claim 1 and wherein the shake shingle impression siding includes at least one course of shake shingle impressions with the shake shingle impressions having bottom edges selected from the group consisting of substantially square bottom edges, beveled bottom edges, scalloped bottom edges, and combinations thereof.

3. The corner piece of claim 1 and wherein the at least one of said first upper side edge and second upper side edge having the field modifiable fill strip is selected from the group consisting of rightward second lateral edges and leftward second lateral edges.

4. The corner piece of claim 1 and wherein the corner piece comprises PVC or polypropylene.

5. The corner piece of claim 1 and wherein the structure corner is an outside corner.

6. The corner piece of claim 1 and wherein the structure corner is an inside corner.

7. The corner piece of claim 1 and wherein the shake shingle impression siding adjacent the structure corner includes a panel having multiple stacked courses of multiple shake shingle impressions.

8. The corner piece of claim 1 and further including:

a nailing flange at an upper extent of the corner piece, the nailing flange including a first hook, the first hook directed downwardly substantially parallel to the first wall and a second hook, the second hook directed downwardly substantially parallel to the second wall; and, a hook receiver on the interior faces adjacent the lower edge of the corner piece.

9. The corner piece of claim 8, wherein there is a gap between the first hook and the second hook.

10. A method of siding a structure at a structure corner, the structure corner being defined by mating first and second walls, the method comprising the steps of:

providing a first siding panel and a second siding panel, each having at least one course of decorative impressions, the decorative impressions defining a contour characterized by lineal variability along the at least one course of decorative impressions;

fastening the first siding panel to the first wall and the second siding panel to the second wall such that the at least one course of decorative impressions of the first and the second siding panels are mutually horizontally oriented and aligned adjacent the structure corner, thereby defining end portions of the siding panels adjacent the structure corner;

providing a corner piece having a first decorative impression and a second decorative impression, the first and second decorative impressions meeting at a common corner, the first decorative impression having an exterior face and interior face and further having, opposite the common corner, an edge including at least two field modifiable fill strips, one of the at least two field modifiable fill strips situated at a bottom of the edge and one of the at least two field modifiable fill strips situated above the bottom of the edge, and oriented with an upwardly directed abutment edge and a vertical face depending therefrom, the vertical face generally perpendicular to the exterior and interior faces of the first decorative impression, wherein the field modifiable fill strips include increments in the form of indents;

observing the contour adjacent the end portion of the first siding panel and, if needed, removing any interfering portion of the field modifiable fill strip to modify the upwardly directed abutment edge so as to reflect and accommodate the observed contour within the edge and remaining portion of the field modifiable fill strip; and, attaching the corner piece so as to align the common corner with the structure corner, align the first decorative impression of the corner piece with the at least one course of decorative impressions of the first siding panel, and overlap the end portions of the siding panels, wherein the observed contour is reflected and accommodated within the edge and remaining portion of the field modifiable fill strip such that a significant gap is avoided between the upwardly directed abutment edge of the field modifiable fill strip and the contour adjacent the end portion of the first siding panel.

11. The method of claim 10 and wherein the corner piece has an impression of two stacked mitered shake shingles.

12. The method of claim 10 and wherein the decorative impressions of the at least one course of decorative impressions of the first siding panel consist of a fixed number of decorative impressions, each of the decorative impressions of the fixed number of decorative impressions characterized by a distinct impression contour, which distinct impression contour of the decorative impression of the end portion may be determined in the step of observing the contour, such that the necessity of removing any interfering portion of the field modifiable fill strip may be ascertained prior to removing any portion of the field modifiable fill strip.

13. The method of claim 12 and wherein the contour differences at the bottom edge of the shake shingle contours are selected from the group consisting of bottom height differences, bevel angle differences, and combinations thereof.

14. The method of claim 10 and wherein the first siding panel is terminated at a lineal extent based upon distance from an opposite corner of the first wall, thereby determining the observed contour of the end portion of the first siding panel adjacent the structure corner, the end portion of the terminated first siding panel and the edge with remaining portion of field modifiable fill strip both overlying the first wall adjacent the structure corner.

15. The method of claim 10 and wherein the corner piece includes an upper nailing flange having a downwardly directed hook and the corner piece further includes a lower hook receiver adapted to receive the downwardly directed hook of the upper nailing flange and wherein the step of attaching the corner piece includes the steps of:

aligning the corner piece with the structure corner;

sliding the aligned corner piece upwardly along the structure corner to engage the downwardly directed hook of a previously attached corner piece in the lower hook receiver; and, fastening the nailing flange of the aligned, slid and engaged lower hook receiver corner piece to the structure corner.

16. A system for siding a structure, the structure having a plurality of walls of predetermined horizontal extent, at least two of the walls mating at a structure corner, the system comprising:

a plurality of siding panels, suitable for application to the walls, the siding panels characterized by a lineally variable contour and being lineally terminable to coordinate with the predetermined horizontal extent of the walls mating at the structure corner; and, a plurality of corner pieces, the corner pieces suitable for application to the structure corner subsequent to application of the siding panels, so as to cap the siding panels at the structure corner, the corner pieces characterized by a first corner panel and a second corner panel, the corner panels each having interior and exterior faces and meeting at a common corner and at least two field modifiable trim strips on an edge of one of the corner panels opposite the common corner, one of the at least two field modifiable trim strips situated at a bottom of the edge and one of the at least two field modifiable trim strips situated above the bottom of the edge, wherein the field modifiable trim strips include increments in the form of indents the field modifiable trim strips having an upwardly directed abutment edge and a vertically oriented face depending therefrom, said vertically oriented face generally perpendicular to the faces of the first corner panel of the edge, wherein modification of the field modifiable trim strip modifies the upwardly directed abutment edge and facilitates reflection and accommodation of the lineally variable contour observed adjacent a termination of a siding panel, such that a significant gap may be avoided between the upwardly directed abutment edge of the field modifiable trim strip of the corner piece and the terminated siding panel.

17. The system of claim 16 and wherein the corner pieces of the plurality of corner pieces have at least two shake shingle impression courses and convey an impression of mitered shake shingles.

18. The system of claim 16 and wherein the field modifiable trim strip has a thickness not more than half of the thickness of the bulk of the corner piece.

19. The system of claim 16 and wherein the field modifiable trim strip has three indents corresponding to three of the four bottom extends, such that an installer observing an interference of one of three bottom extents needs only select the one corresponding indent of the three indents and trim the field modifiable trim strip at that one corresponding indent, thereby avoiding a significant gap.

20. The system of claim 16 and wherein the siding panels and corner pieces are composed of polymeric material comprising PVC or polypropylene.

* * * * *